US009691319B2

(12) United States Patent
Chu-Ke et al.

(10) Patent No.: US 9,691,319 B2
(45) Date of Patent: Jun. 27, 2017

(54) PIXEL AND SUB-PIXEL ARRANGEMENTS IN A DISPLAY PANEL

(71) Applicant: AU OPTRONICS CORPORATION, Hsinchu (TW)

(72) Inventors: Hui Chu-Ke, Hsinchu (TW); Sheng-Wen Cheng, Hsinchu (TW)

(73) Assignee: AU Optronics Corporation, Hsinchu (TW)

( * ) Notice: Subject to any disclaimer, the term of this patent is extended or adjusted under 35 U.S.C. 154(b) by 0 days.

(21) Appl. No.: 15/054,449

(22) Filed: Feb. 26, 2016

(65) Prior Publication Data

US 2016/0196780 A1 Jul. 7, 2016

Related U.S. Application Data

(63) Continuation of application No. 13/749,254, filed on Jan. 24, 2013, now abandoned.

(51) Int. Cl.
*G09G 3/20* (2006.01)

(52) U.S. Cl.
CPC ..... *G09G 3/2003* (2013.01); *G09G 3/2074* (2013.01); *G09G 2300/0426* (2013.01);
(Continued)

(58) Field of Classification Search
CPC ..... G09G 3/2003; G09G 3/2074; G09G 2300/0434; G09G 2300/0439;
(Continued)

(56) References Cited

U.S. PATENT DOCUMENTS 6,714,212 B1 3/2004 Tsuboyama et al.
6,750,875 B1 6/2004 Keely, Jr. et al.
(Continued)

FOREIGN PATENT DOCUMENTS

CN 1637834 7/2005
CN 1722193 1/2006
CN 101777302 7/2010

OTHER PUBLICATIONS

Search Report issued Aug. 19, 2015 in corresponding Chinese patent application CN201310341975.6 (8 pages).
(Continued)

*Primary Examiner* — Grant Sitta
(74) *Attorney, Agent, or Firm* — Ware, Fressola, Maguire & Barber LLP

(57) ABSTRACT

Various arrangements of color sub-pixels in a group of pixels for use in a color display are disclosed. The same group of pixels is repetitively arranged in rows and columns in the color display. In particular, each group of pixels has four pixels arranged on the four quadrants of a rectangle or square. A pixel group may have two sub-pixels in R, two sub-pixels in G, two sub-pixels in B and two sub-pixels in W, but each of the pixels has two different color sub-pixels. In each of the four pixels in a pixel group, the two sub-pixels can be adjacent to each other along the column direction or along the row direction, but the two sub-pixels in at least one pixel are adjacent to each other along the column direction. A pixel group may have two pixels with R, G sub-pixels and two pixels in B.

20 Claims, 8 Drawing Sheets

(52) U.S. Cl.
CPC ..... *G09G 2300/0452* (2013.01); *G09G 2320/0242* (2013.01)

(58) Field of Classification Search
CPC ... G09G 2300/0443; G09G 2300/0447; G09G 2300/0452; G09G 2300/0456; G09G 2300/046; G09G 2300/0465; G09G 2300/0469; G09G 2300/0473; G09G 2300/0478; G09G 2300/0482; G09G 2300/0486; G09G 3/3607; G09G 3/3648; G09G 3/367
USPC ..... 345/87–89
See application file for complete search history.

(56) References Cited

U.S. PATENT DOCUMENTS 7,443,093 B2 10/2008 Jianpu et al.
2004/0108818 A1 6/2004 Cok et al.
2005/0068477 A1 3/2005 Shin et al.
2005/0088385 A1 4/2005 Elliott et al.
2005/0140622 A1 6/2005 Lee et al.
2005/0162600 A1 7/2005 Rho et al.
2005/0225574 A1* 10/2005 Brown Elliott ... G02F 1/133514 345/694
2005/0225575 A1 10/2005 Brown Elliott et al.
2007/0257945 A1* 11/2007 Miller ..... G09G 3/2003 345/694
2008/0259256 A1 10/2008 Dong
2010/0277677 A1 11/2010 Nakamura et al.
2012/0193515 A1 8/2012 Agranov et al.

OTHER PUBLICATIONS

Taiwan Office Action issued Oct. 3, 2014, in corresponding TW application (8 pages).

* cited by examiner

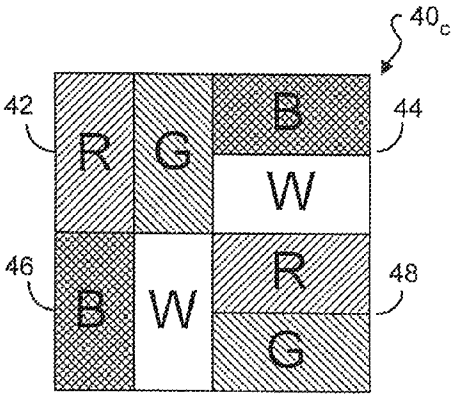
FIG. 2c
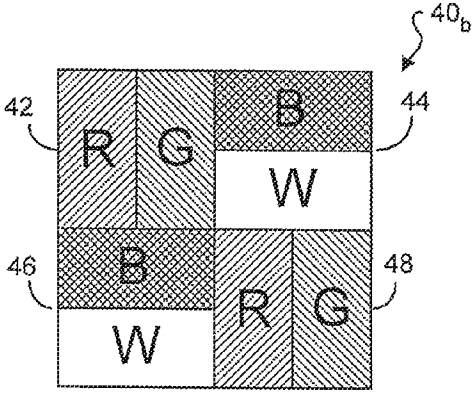
FIG. 2b
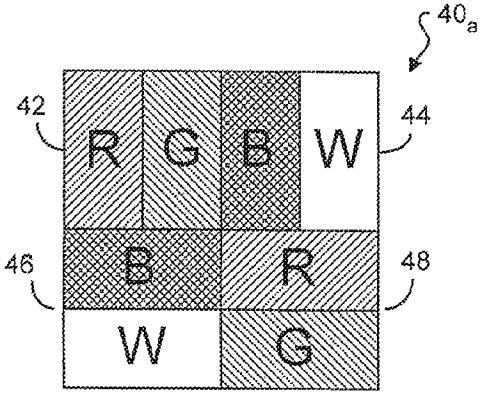
FIG. 2a
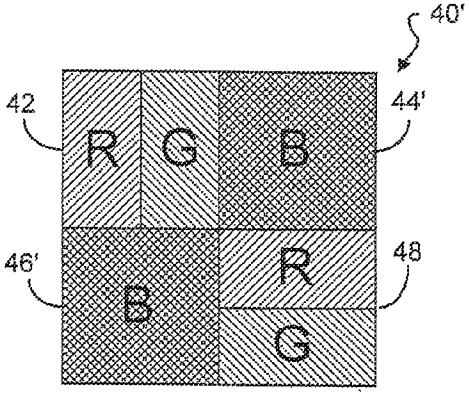
FIG. 2d
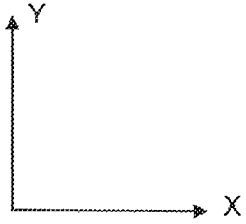

PIXEL AND SUB-PIXEL ARRANGEMENTS IN A DISPLAY PANEL

CROSS REFERENCE TO RELATED PATENT APPLICATION

This application claims priority under 35 USC §119 to U.S. patent application Ser. No. 13/749,254, filed Jan. 24, 2013, whose entire contents are hereby incorporated by reference.

FIELD OF THE INVENTION

The present invention generally relates to a display panel and, more specifically, to pixel arrangements in a display panel.

BACKGROUND OF THE INVENTION

A typical liquid crystal display (LCD) panel or organic light-emitting diode (OLED) panel has a plurality of pixels arranged in a two-dimensional array, driven by a data driver and a gate driver. As shown in FIG. 1, the LCD pixels 10 in a LCD panel 1 are arranged in rows and columns in a display area 100. A data driver 200 is used to provide signals indicative of data to each of the columns and a gate driver is used to provide gate-line signals to each of the rows. In a color display panel, an image is generally presented in three colors: red (R), green (G) and blue (B). Each of the pixels 10 is typically divided into three color sub-pixels: red sub-pixel, green sub-pixel and blue sub-pixel. In some color display panels, each of the pixels 10 also has a white (W) sub-pixel.

The arrangement of the color sub-pixels in a pixel would have a different visual effect.

SUMMARY OF THE INVENTION

The present invention provides various arrangements of sub-pixels in a group of pixels. The same group of pixels is repetitively used in rows and columns in a color display. In particular, each group of pixels has four pixels arranged on the four quadrants of a rectangle or square, and at least two of the pixels have two sub-pixels. Among the four pixels in a pixel group, the two sub-pixels in at least one pixel are arranged to be adjacent to each other along the column direction.

Thus, the first aspect of the present invention is a display panel, which comprises a plurality of pixel groups arranged in a plurality of rows in a first direction and a plurality of columns in a second direction, each pixel group comprising four pixels such that each of the four pixels is adjacent to another one of the four pixels in the first direction and also adjacent to a different one of the four pixels in the second direction, wherein at least two of the four pixels in a pixel group have two color sub-pixels; a plurality of gate lines arranged in the first direction to provide timing control signals to the pixels in the pixel groups in the rows; and a plurality of data lines arranged in the second direction to provide data signals to the color sub-pixels in the pixel groups in the column, wherein the two color sub-pixels in at least one of said at least two of the four pixels are adjacent to each other in the second direction.

The second aspect of the present invention is a method for use in a display panel, the display panel comprising:

a plurality of pixel groups arranged in a plurality of rows in a first direction and a plurality of columns in a second direction, each of the pixel groups comprising four pixels, said method comprising:

arranging the four pixels in each of the pixel groups such that each of the four pixels is adjacent to another one of the four pixels in the first direction and also adjacent to a different one of the four pixels in the second direction, wherein at least two of the four pixels in a pixel group have two color sub-pixels;

arranging a plurality of gate lines in the first direction to provide timing control signals to the pixels in the pixel groups in the rows; and arranging a plurality of data lines in the second direction to provide data signals to the color sub-pixels in the pixel groups in the column, wherein the two color sub-pixels in at least one of said at least two of the four pixels are adjacent to each other in the second direction.

In one embodiment of the present invention, the four pixels in the pixel group comprise: a first pixel, a second pixel adjacent to the first pixel in the first direction, a third pixel adjacent to the first pixel in the second direction, and a fourth pixel adjacent to the second pixel in the second direction and also adjacent to third pixel in the first direction.

In some embodiments of the present invention, each of the first pixel and the fourth pixel comprises a first color sub-pixel and a second color sub-pixel, and each of the second pixel and the third pixel comprises a third color sub-pixel and a fourth color sub-pixel.

In other embodiments of the present invention, each of the first pixel and the fourth pixel comprises a first color sub-pixel and a second color sub-pixel, and each of the second pixel and the third pixel comprises a third color sub-pixel.

In one arrangement of the color sub-pixels, the first color sub-pixel and the second color sub-pixel in the first pixel are adjacent to each other in the first direction; the third color sub-pixel and the fourth color sub-pixel in the second pixel are adjacent to each other in the first direction; the third color sub-pixel and the fourth color sub-pixel in the third pixel are adjacent to each other in the second direction; and the first color sub-pixel and the second color sub-pixel in the fourth pixel are adjacent to each other in the second direction; and the plurality of gate lines comprise a first gate line arranged to provide the timing control signals to the first pixel and the second pixel, and a second gate line arranged to provide the timing control signals to the third pixel and the fourth pixel.

In another arrangement of the color sub-pixels, the first color sub-pixel and the second color sub-pixel in the first pixel are adjacent to each other in the first direction; the third color sub-pixel and the fourth color sub-pixel in the second pixel are adjacent to each other in the first direction; the third color sub-pixel and the fourth color sub-pixel in the third pixel are adjacent to each other in the second direction, and the first color sub-pixel and the second color sub-pixel in the fourth pixel are adjacent to each other in the second direction; and the plurality of gate lines comprise a first gate line arranged to provide the timing control signals to the first pixel and the second pixel; a second gate line arranged to provide the timing control signals to the third color sub-pixel in the third pixel and the first color sub-pixel in the fourth pixel; and a third gate line arranged to provide the timing control signals to the fourth color sub-pixel in the third pixel and the second color sub-pixel in the fourth pixel.

In a different arrangement of the color sub-pixels, the first color sub-pixel and the second color sub-pixel in the first pixel are adjacent to each other in the first direction; the third color sub-pixel and the fourth color sub-pixel in the second pixel are adjacent to each other in the second direction; the third color sub-pixel and the fourth color sub-pixel in the third pixel are adjacent to each other in the first direction; and the first color sub-pixel and the second color sub-pixel in the fourth pixel are adjacent to each other in the second direction; and the plurality of gate lines comprise a first gate line arranged to provide the timing control signals to the first pixel and the second pixel, and a second gate line arranged to provide the timing control signals to the third pixel and the fourth pixel.

In yet another arrangement of the color sub-pixels, the first color sub-pixel and the second color sub-pixel in the first pixel are adjacent to each other in the first direction; the third color sub-pixel and the fourth color sub-pixel in the second pixel are adjacent to each other in the second direction; the third color sub-pixel and the fourth color sub-pixel in the third pixel are adjacent to each other in the second direction; and the first color sub-pixel and the second color sub-pixel in the fourth pixel are adjacent to each other in the first direction, and the plurality of gate lines comprise a first gate line arranged to provide the timing control signals to the first pixel and the second pixel, and a second gate line arranged to provide the timing control signals to the third pixel and the fourth pixel.

In a pixel group that has four color sub-pixels, the color sub-pixels are in red, green, blue and green and each pixel has two different color sub-pixels. In a pixel group that has three color sub-pixels, the color sub-pixels are in red, green and blue and each of two pixels has two different color sub-pixels and each of two pixels has one color sub-pixel.

BRIEF DESCRIPTION OF THE DRAWINGS

FIG. 2*a* to FIG. 2*c* show three different sub-pixel arrangements in a pixel group, according to various embodiments of the present invention.

FIG. 2*d* shows a different pixel group, according to yet another embodiment of the present invention.

DETAILED DESCRIPTION

The present invention provides a method for arranging the color sub-pixels in a group of adjacent pixels. In various embodiments of the present invention, the pixels in a display panel are arranged in groups in a repetitive pattern, and each group has four pixels. As shown in FIGS. 2*a* to 2*c*, each pixel group 40 has four pixels 42, 44, 46 and 48, and each pixel has two color sub-pixels. Each of the pixels 42, 48 has R and G sub-pixels and each of the pixels 44, 46 has B and W. In a different embodiment as shown in FIG. 2*d*, in the pixel group 40', pixels 42, 48 have R and G color sub-pixels, but pixels 46', 48' have only one color sub-pixel B. Pixels 42 and 44 are referred to as the upper pixels and pixels 46 and 48 are referred to as the lower pixels in a pixel group 40 or 40'.

Figure 3:
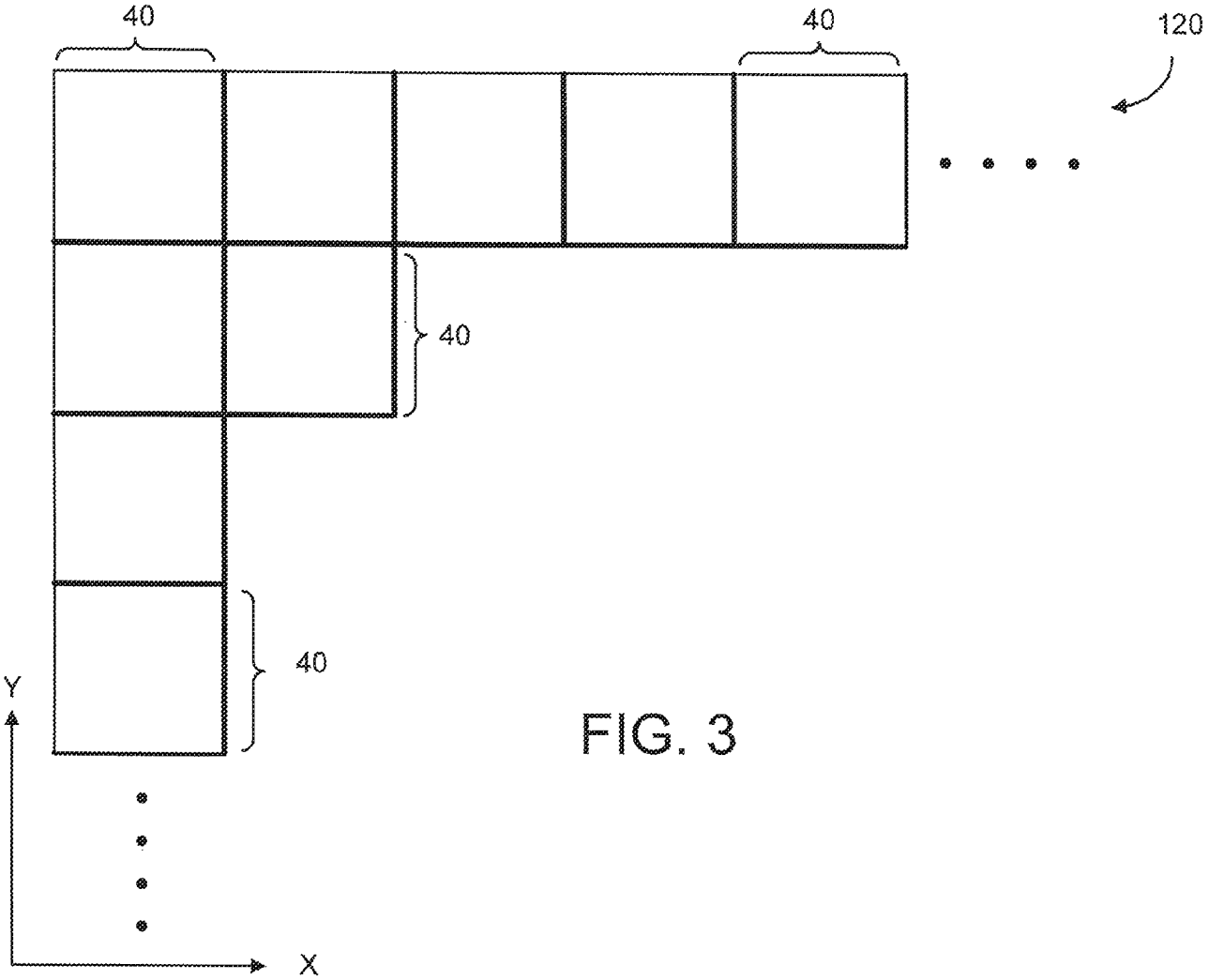
FIG. 3 shows a plurality of pixel groups arranged in rows and columns in a display panel, according to one embodiment of the present invention.
Figure 3A:
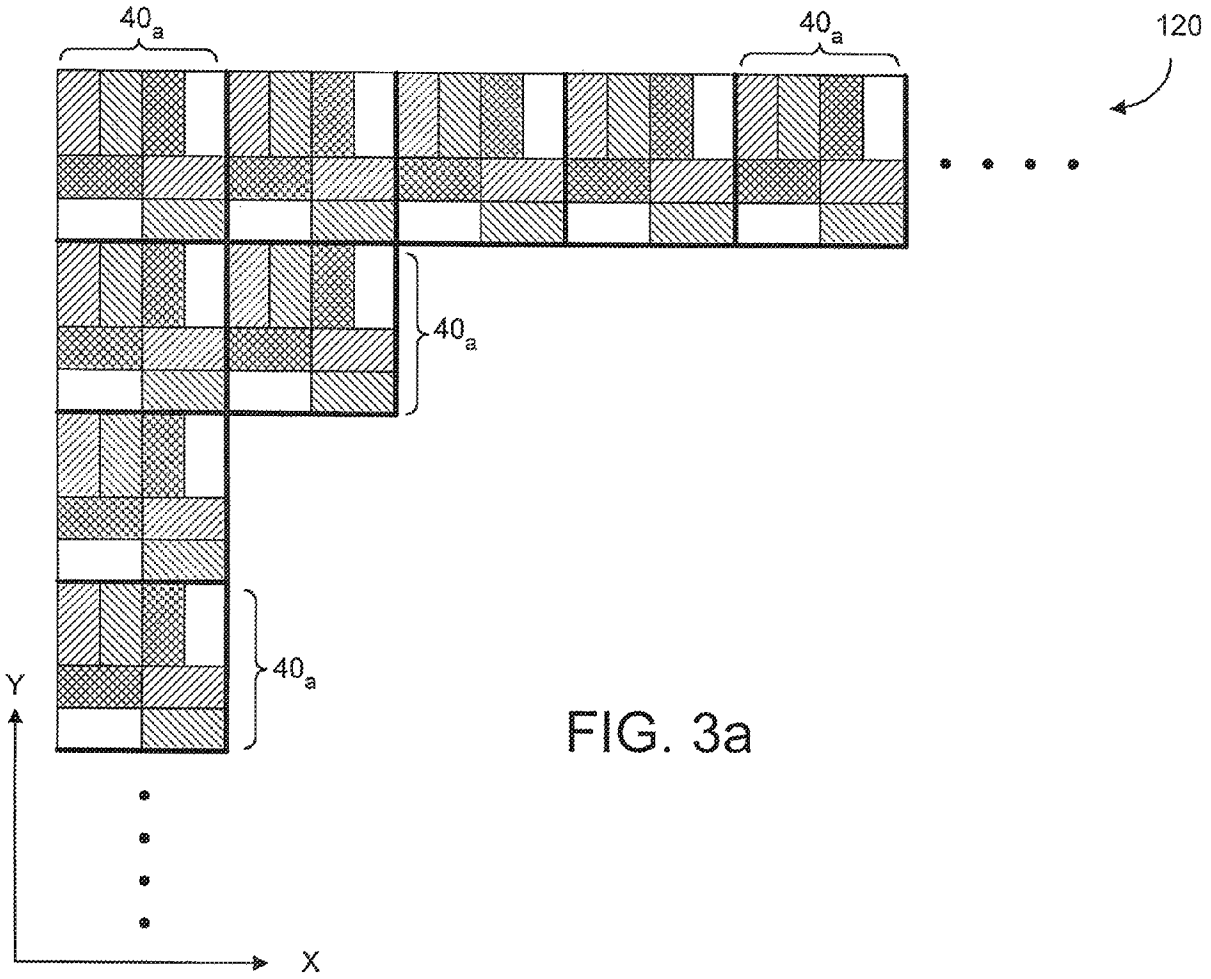
FIG. 3*a* shows the pixel groups as shown in FIG. 2*a* used in a display panel.

A display panel 120, according to the disclosure of the present invention, comprises a plurality of same pixel groups 40 or 40' arranged in rows in the X direction and columns in the Y direction as shown in FIG. 3. In FIG. 3*a*, each of the pixel groups represents pixel group 40*a* as shown in FIG. 2*a*. As shown in FIG. 2*a*, pixel group 40*a* has four pixels 42, 44, 46 and 48. Pixel 42 is adjacent to pixel 44 in the X direction and adjacent to pixel 46 in the Y direction. Pixel 48 is adjacent to pixel 46 in the X direction and also adjacent to pixel 44 in the Y direction. Similarly, pixel 44 is adjacent to pixel 42 in the X direction and adjacent to pixel 48 in the Y direction. Pixel 46 is adjacent to pixel 48 in the X direction and also adjacent to pixel 42 in the Y direction. In other words, each of the (R, G) pixels is adjacent to one (B, W) pixel in the X direction and also adjacent to another (B, W) pixel in the Y direction. Similarly, each of the (B, W) pixels is adjacent to one (R, G) pixel in the X direction and also adjacent to another (R, G) pixel in the Y direction. In the embodiment as shown in FIG. 2*a*, the R sub-pixel and the G sub-pixel in pixel 42 are adjacent to each other in the X direction, whereas the R sub-pixel and the G sub-pixel in pixel 48 are adjacent to each other in the Y direction. The B sub-pixel and the W sub-pixel in pixel 44 are adjacent to each other in the X direction, whereas the B sub-pixel and the W sub-pixel in pixel 46 are adjacent to each other in the Y direction.

In the embodiment as shown in FIG. 2*b*, pixel group 40*b* has four pixels 42, 44, 46 and 48. The R sub-pixel and the G sub-pixel in both pixels 42 and 48 are adjacent to each other in the X direction, whereas the B sub-pixel and the W sub-pixel in both pixels 44 and 46 are adjacent to each other in the Y direction.

In pixel group 40*c* as shown in FIG. 2*c*, the R sub-pixel and the G sub-pixel in pixel 42 are adjacent to each other in the X direction, whereas the R sub-pixel and the G sub-pixel in pixel 48 are adjacent to each other in the Y direction. In pixel 46, the B sub-pixel and the W sub-pixel are adjacent to each other in the X direction, whereas the B sub-pixel and the W sub-pixel in pixel 44 are adjacent to each other in the Y direction.

In the embodiment as shown in FIG. 2*d*, in pixel 42, the R sub-pixel and the G sub-pixel are adjacent to each other in the X direction, whereas, in pixel 48, the R sub-pixel and the G sub-pixel are adjacent to each other in the Y direction.

Thus, according to various embodiments of the present invention, in any pixel group 40 or 40', two color sub-pixels in at least one pixel are adjacent to each other in the Y direction. When pixels with two color sub-pixels arranged to be adjacent to each other in the Y direction are mixed with pixels in which two color sub-pixels are adjacent to each other in the X direction, and such pixel groups are repetitively arranged in rows (in the X direction) and in columns (in the Y direction), a Moire pattern is less likely to appear. Thus, the grouping of pixels with different color sub-pixel arrangements, according to various embodiments of the present invention, improves the visual quality of a color display such as LCD display, LED display, OLED display and plasma display.

Figure 1:
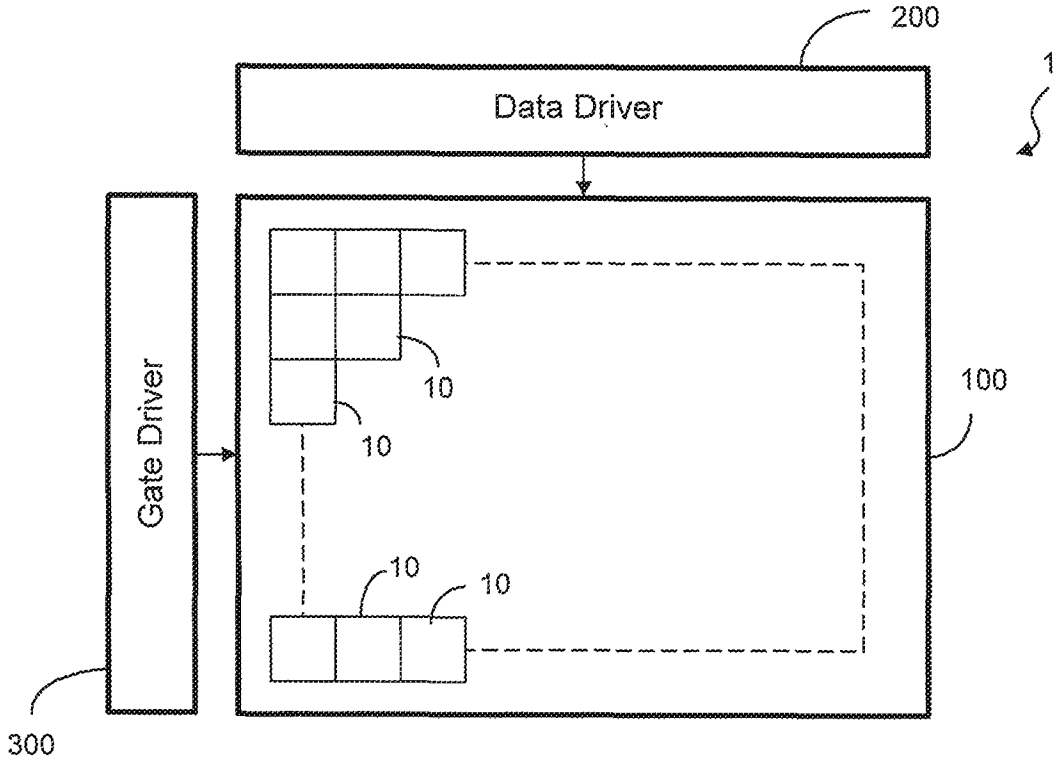
FIG. 1 (prior art)
FIG. 1 shows a typical display panel having rows and columns of pixels in a display area.
Figure 4B:
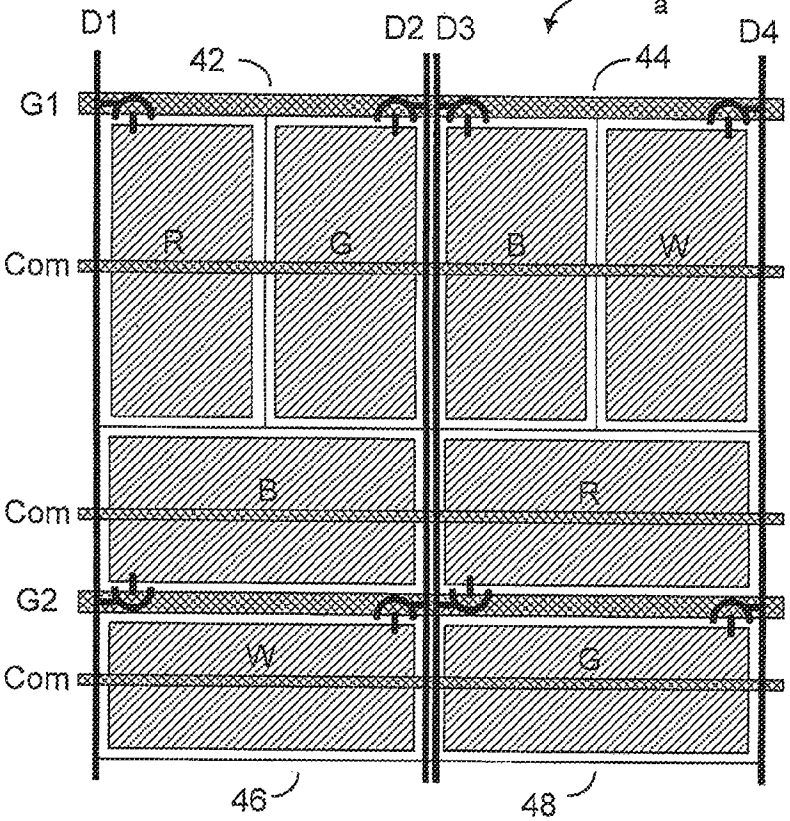
FIGS. 4*a* and 4*b* show different arrangements of gate lines and common lines in a display panel as shown in FIG. 3*a*.
Figure 4A:
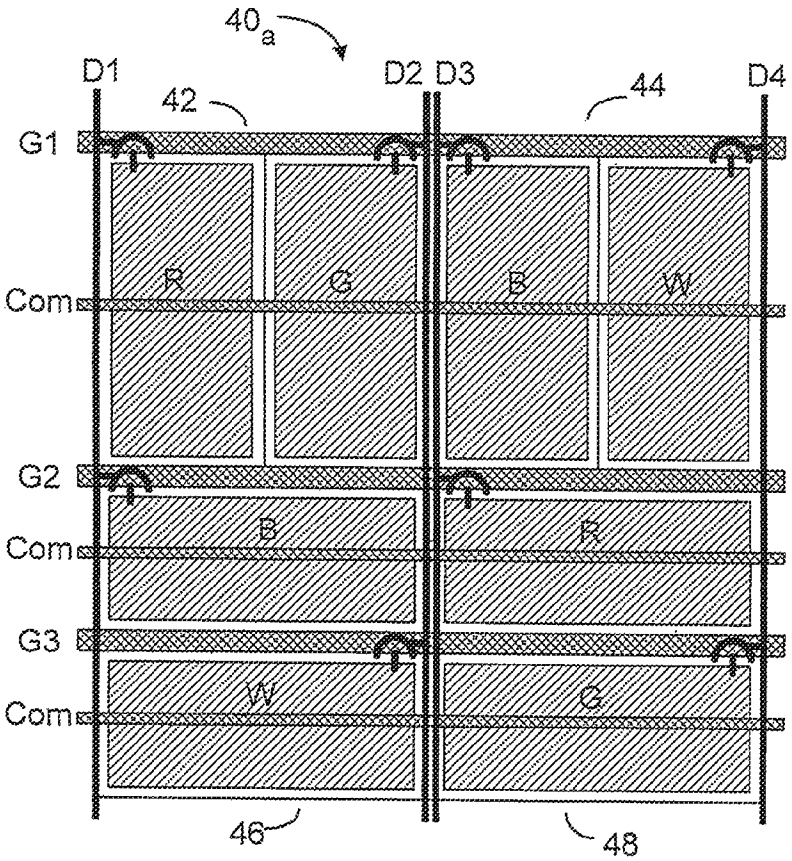

In general, when a display panel comprises a plurality of pixels arranged in a plurality of rows and columns as shown in FIG. 1, each row of pixel has a gate line to receive a gate line signal in order to activate the pixels in the row. If a pixel has three color sub-pixels or four color sub-pixels, then three or four data lines are used to provide data signals to the color sub-pixels in a column. When a display panel 120 comprises a plurality of pixel groups 40 as shown in FIG. 3, two or three gate lines can be used to receive gate lines signals in order to activate the color sub-pixels in a row of pixel groups 40 or 40'. Furthermore, at least four data lines are used to provide data signals to the color sub-pixels. If the pixel group 40*a* as shown in FIG. 2*a* is used in a display panel (see FIG. 3*a*), four data lines D1, D2, D3 and D4 are used to provide data signals to color sub-pixels R, G, B and W as shown in FIG. 4*a*. In one embodiment of the present invention, three gate lines G1, G2 and G3 are used. As shown in FIG. 4*a*, date lines D1, D2, D3 and D4 are arranged to provide data signals to the R, G, B and W color sub-pixels in the upper pixels when the gate-line signal in G1 is on. When gate-line signal in G2 is on, data lines D1 and D3 are arranged to provide data signals to B and R color sub-pixels in the lower pixels. Similarly, when gate-line signal in G3 is on, data lines D2 and D4 are arranged to provide data signals to W and G color sub-pixels in the lower pixels. Since the lower pixels are effectively split into two sub-rows, each of the sub-rows uses a separately common line to provide a reference voltage. Thus, in the embodiment as shown in FIG. 4*a*, three common lines are used to provide the reference voltage to a row of pixel groups 40*a*. In a different embodiment of the present invention, only two gate lines are used to provide gate-line signals to each row of pixel groups 40*a*. As shown in FIG. 4*b*, when the gate-line signal in G1 is on, data lines D1, D2, D3 and D4 are arranged to provide data signals to R, G, B and W color sub-pixels in the upper pixels. When the gate-line signal in G2 is on, data lines D1, D2, D3 and D4 are arranged to provide data signals to B, W, R and G color sub-pixels in the lower pixels.

Figure 6:
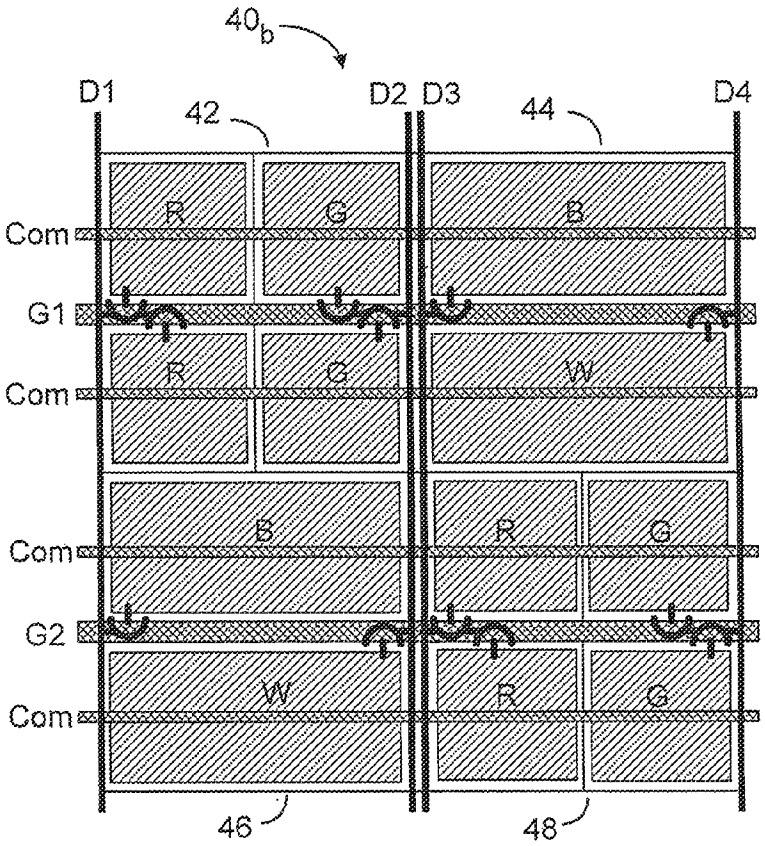
FIG. 6 shows an arrangement of the gate lines, common lines and data lines in a display panel when the pixel arrangement of FIG. 2*b* is used.
Figure 5:
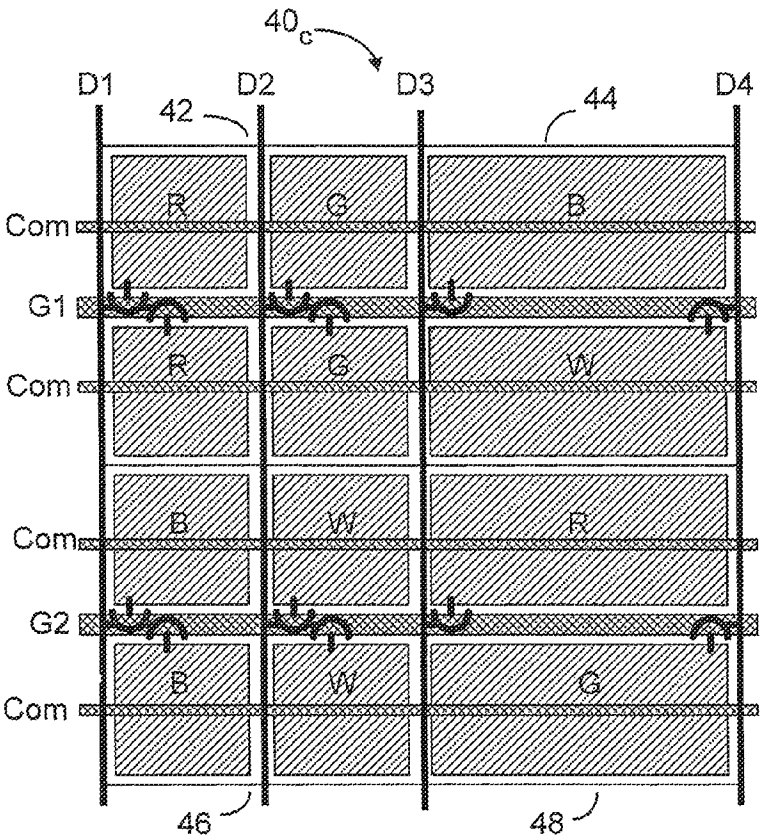
FIG. 5 shows an arrangement of gate lines, common lines and data lines in a display panel when the pixel arrangement of FIG. 2*c* is used.

In the pixel arrangement as shown in FIG. 2*a*, in each of the upper pixels 42 and 44, the two color sub-pixels are adjacent to each other in the X direction. Thus, one common line can be used to provide a reference voltage to the color sub-pixels in the upper pixels. In each of the lower pixels 46 and 48, the two color sub-pixels are adjacent to each other in the Y direction. Two common lines are used to provide the reference voltage to the color sub-pixels in the lower pixels as shown in FIGS. 4*a* and 4*b*. In the pixel arrangements as shown in FIG. 2*c*, two common lines are used to provide the reference voltage to B and W color sub-pixels in the upper pixel 44, and two more common lines are used to provide the reference voltage to R and G color sub-pixels in the lower pixel 48. As shown in FIG. 5, because gate line G1 is arranged to activate both B and W color sub-pixels in pixel 44, each of R color sub-pixel and G color sub-pixel in pixel 42 is effectively split into two parts. As gate line G2 is arranged to activate both R and G color sub-pixels in pixel 48 (see pixel group 40*c* in FIG. 2*c*), each of B color sub-pixel and W color sub-pixel in pixel 46 is effectively split into two parts. Similarly, in the pixel arrangements as shown in FIG. 2*b*, two common lines are used to provide the reference voltage to B and W color sub-pixels in the upper pixel 44, and two more common lines are used to provide the reference voltage to B and W color sub-pixels in the lower pixel 46. As shown in FIG. 6, because gate line G1 is arranged to activate both B and W color sub-pixels in pixel 44, each of R color sub-pixel and G color sub-pixel in pixel 42 is effectively split into two parts. As gate line G2 is arranged to activate both B and W color sub-pixels in pixel 46 (see pixel group 40*b* in FIG. 2*b*), each of R color sub-pixel and G color sub-pixel in pixel 48 is effectively split into two parts.

It should be noted that, in FIG. 5, data line D2 is located between R color sub-pixel and G color sub-pixel in the upper pixel 42, and between B color sub-pixel and W color-sub-pixel in the lower pixel 46. As such, D2 is located on the left side of G and W color sub-pixels in the pixels 42 and 46. It is possible to relocate D2 to the right side of G and W color sub-pixels in the pixels 42 and 46. As such, D2 and D3 are adjacent to each other as shown in FIG. 6.

Figure 7:
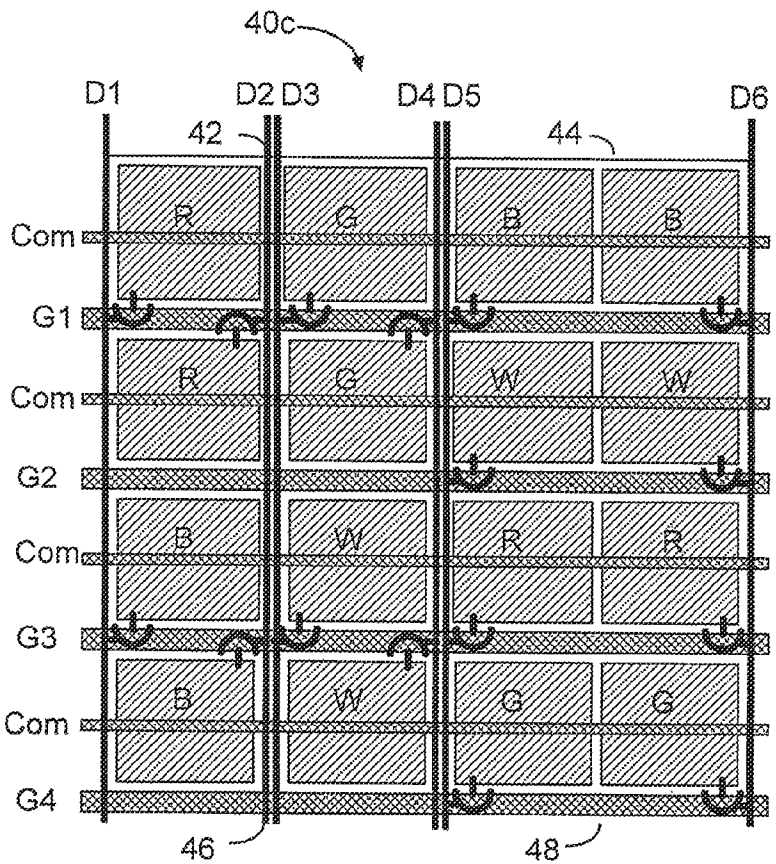
FIG. 7 shows another arrangement of gate lines, common lines and data lines in a display panel when the pixel arrangement of FIG. 2*c* is used.

FIG. 7 shows a different arrangement of gate lines and data lines when the pixel arrangement of FIG. 2*c* is used. As shown in FIG. 7, the pixel group 40*c* (see FIG. 2*c*) may have four gate lines G1, G2, G3 and G4 and six data lines D1-D6. When the gate-line signal in G1 is on, data lines D1, D2 are arranged to provide data signal to R color sub-pixel in the upper pixel 42; data lines D3, D4 are arranged to provide data signal to G color sub-pixel in the upper pixel 42; and data lines D5, D6 are arranged to provide data signal to B color sub-pixel in the upper pixel 44. When gate-line signal in G2 is on, data lines D5 and D6 are arranged to provide data signal to W color sub-pixel in the upper pixel 44. When the gate-line signal in G3 is on, data lines D1, D2 are arranged to provide data signal to B color sub-pixel in the lower pixel 46; data lines D3, D4 are arranged to provide data signal to W color sub-pixel in the lower pixel 46; and data lines D5, D6 are arranged to provide data signal to R color sub-pixel in the lower pixel 48. When gate-line signal in G4 is on, data lines D5 and D6 are arranged to provide data signal to G color sub-pixel in the lower pixel 48.

Figure 8:
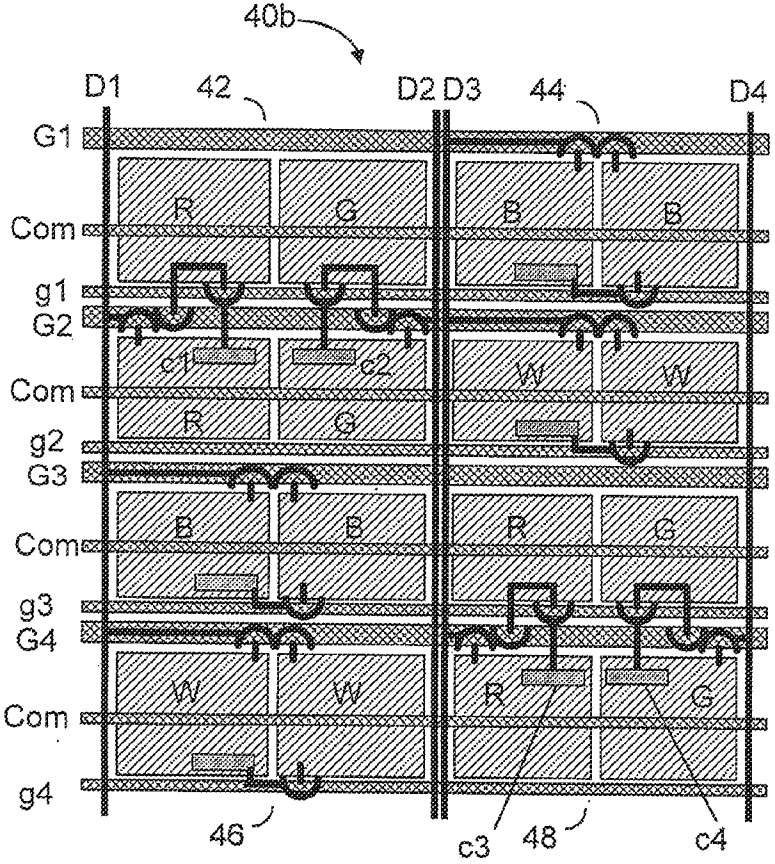
FIG. 8 shows a charge-sharing scheme when the pixel arrangement of FIG. 2*b* is used.
Figure 9B:
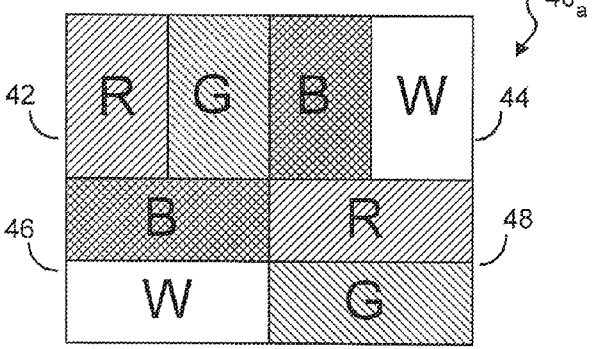
FIGS. 9*a*-9*d* show different shapes of the pixels as illustrated in FIGS. 2*a* and 2*b*.
Figure 9A:
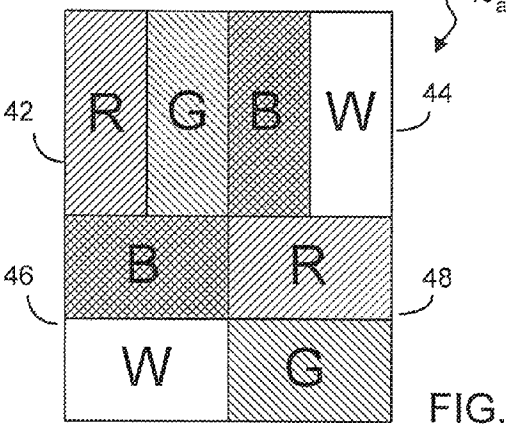
Figure 9D:
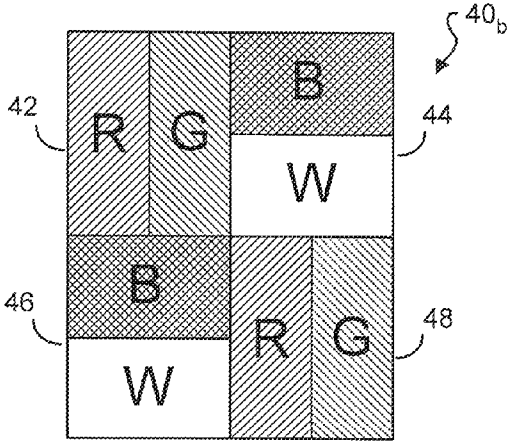
Figure 9C:
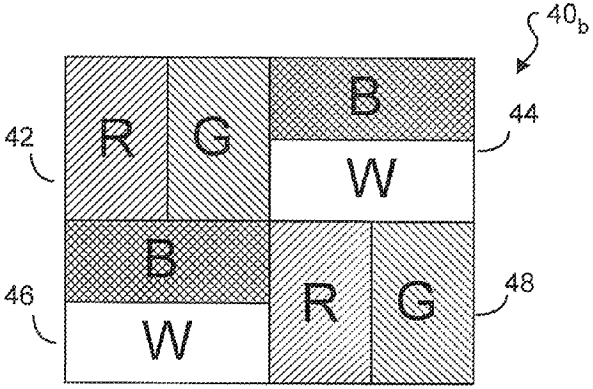

FIG. 8 shows a charge-sharing scheme according to a different embodiment of the present invention. In FIG. 8, the pixel group 40*b* (see FIG. 2*b*) is used to illustrate how charge-sharing is arranged. In FIG. 8, eight gate-lines are used to activate the upper and lower pixels 42, 44, 46 and 48. G1-G4 are main gate lines and g1-g4 are charge-sharing gate lines. As with the driving schemes as shown in FIGS. 4*a*, 4*b*, 5, 6 and 7, the timings for providing the gate-line signals on G1-G4 are non-overlapping. However, the gate-line signals in g1, G2 are overlapping or they are simultaneously provided. The gate-line signals on the other pairs (g2, G3), (g3, G4) are similarly provided. Charge sharing is applied to where a color sub-pixel is split into two portions. As shown in FIG. 8, each of the R, G, B and W color sub-pixels is split into two portions. In order to apply charge-sharing in the R, G color sub-pixels in the upper pixel 42 and the lower pixel 48, gate line g1 is arranged to share the charge when the gate-line signal in G2 is on, and gate line g3 is arranged to share the charge when the gate-line signal in G4 is on. When the gate-line signal in G1 is on, data lines D3, D4 are arranged to provide data signals to the B color sub-pixel in the upper pixel 44. When G2 is on, data line D3 is arranged to provide data signals to the W color sub-pixel in the upper pixel 44. At the same time data line D1 and data line D2 are arranged to separately provide data signals to R and G color sub-pixels in the upper pixel 42. Furthermore, part of the charge in the R color sub-pixel is stored in the charge-storage capacitor c1 through the active gate line g1. Likewise, part of the charge in the G color sub-pixel is stored in the charge-storage c2. When G3 is on, data line D1 is arranged to provide data signals to the B color sub-pixel in the lower pixel 46. When G4 is on, data line D1 is arranged to provide data signals to the W color sub-pixel in the lower pixel 46. At the same time data line D3 and data line D4 are arranged to separately provide data signals to R and G color sub-pixels in the lower pixel 48. Furthermore, part of the charge in the R color sub-pixel is stored in the charge-storage capacitor c3 through the active gate line g3. Likewise, part of the charge in the G color sub-pixel is stored in the charge-storage c4. Similarly, charge sharing is applied to the split B, W color sub-pixels in pixels 44 and 46. As shown in FIG. 8, a charge-storage capacitor in the upper pixel 44 is charged through the active gate line g1, the charge-storage capacitor is provided in one of the portions in a split B or W pixel so as to share the charge to the other portion via a TFT activated by a charge-sharing gate line.

In summary, the present invention provides various arrangements of color sub-pixels in a group of pixels. The same group of pixels is repetitively used in rows and columns in a color display. In particular, each group of pixels has four pixels arranged on the four quadrants of a rectangle or square, and each pixel has two sub-pixels. In some embodiments of the present invention, a pixel group has two sub-pixels in R, two sub-pixels in G, two sub-pixels in B and two sub-pixels in W. In different embodiments of the present invention, a pixel group has two sub-pixels in R, two sub-pixels in G and two pixels in B. Among the four pixels in a pixel group, the two sub-pixels in at least one pixel are adjacent to each other along the column direction or Y direction as shown in FIG. 3*a*. The color displays that use the arrangements of color sub-pixels in a group of pixels, according to various embodiments of the present invention, include OLED displays, LED displays, LCD displays, plasma display and any color display having rows and columns of pixels.

It should be noted that the placement of the color sub-pixels in FIGS. 2*a*-2*d* is for illustration purposes only. In any pixel group, the pairing of different color sub-pixels can vary and the placement of the color sub-pixel pairs can also vary, so long as the color pairs in two adjacent pixels along the row direction or along the column direction are different. For example, the color sub-pixel pairs in pixels 42 and 46, or in pixels 42 and 44 can be (R, G) and (B, W); (R, B) and (G, W); or (R, W) and (G, B). Furthermore, the shape of pixels 42, 44, 46 and 48 in the pixel groups 40*a*, 40*b*, 40*c* and 40' (see FIGS. 2*a*-2*d*) is not necessarily square. The pixels can also be rectangular as shown in FIGS. 9*a*-9*d*. In each of arrangements as shown in FIGS. 9*a*-9*d*, the area of each pixel is the same. Although the aspect ratio (wider edge/narrower edge) of the sub-pixels may be different, the sub-pixel area is the same. For example, the aspect ratio of the R sub-pixel in pixel 42 is greater than the aspect ratio of the R sub-pixel in pixel 48, but their areas are equal. It is understood that, in general, only the pixel group of the same sub-pixel arrangement and the same shape is used in a display so that gate lines and data lines are easier to arrange. Furthermore, the areas of the two color sub-pixels in a pixel can be equal or different.

It should also be noted that the gate-lines and data-lines arrangements as shown in FIG. 4*a* to FIG. 8 are also for illustration purposes only.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A display panel, comprising:

a plurality of pixel groups arranged in a first direction and a different second direction in a two-dimensional array, each pixel group comprising four pixels, including a first pixel, a second pixel, a third pixel and a fourth pixel, such that the first pixel is arranged in parallel immediately adjacent to the second pixel in the first direction and also arranged in parallel immediately adjacent to the third pixel in the second direction, wherein the first pixel and the second pixel are different in color content, and the first pixel and the third pixel are different in color content, and wherein the first and fourth pixels have same color content, and the second and third pixels have same color content, and wherein the first pixel consists of a first color sub-pixel and a different second color sub-pixel arranged in parallel to each other and immediately adjacent to each other in the first direction, and the second pixel consists of a third color sub-pixel and a different fourth color sub-pixel arranged in parallel to each other and immediately adjacent to each other in the second direction, wherein each of the first color sub-pixel, the second color sub-pixel, the third color sub-pixel and the fourth color sub-pixel has a longer dimension and a shorter dimension such that the longer dimension of the first color sub-pixel is immediately adjacent to the longer dimension of the second color sub-pixel, and the longer dimension of the third color sub-pixel is immediately adjacent to the longer dimension of the fourth color sub-pixel.

2. The display panel according to claim 1, wherein the third pixel consists of the third color sub-pixel and the different fourth color sub-pixel arranged in parallel to each other and immediately adjacent to each other in the second direction, and the fourth pixel consists of the first color sub-pixel and the different second color sub-pixel arranged in parallel to each other and immediately adjacent to each other in the first direction.

3. The display panel according to claim 1, wherein the third pixel consists of the third color sub-pixel and the fourth color sub-pixel arranged in parallel to each other and immediately adjacent to each other in the first direction, and the fourth pixel consists of the first color sub-pixel and the second color sub-pixel arranged in parallel to each other and immediately adjacent to each other in the second direction.

4. The display panel according to claim 1, wherein each of the first color sub-pixel, the second color sub-pixel, the third color sub-pixel and the fourth color sub-pixel is selected from a different one of a red sub-pixel, a green sub-pixel, a blue sub-pixel and a white sub-pixel.

5. The display panel according to claim 1, wherein each of the first color sub-pixel and the second sub-pixel is selected from a different one of a red pixel and a green pixel, and each of the third color sub-pixel and the fourth color sub-pixel is selected from a different one of a blue sub-pixel and a white sub-pixel.

6. A display panel, comprising:

a plurality of pixel groups arranged in a first direction and a different second direction, each pixel group comprising four pixels, including a first pixel, a second pixel, a third pixel and a fourth pixel, such that the first pixel is arranged in parallel immediately adjacent to the second pixel in the first direction and also arranged in parallel immediately adjacent to the third pixel in the second direction, wherein the first pixel and the second pixel are different in color content, and the first pixel and the third pixel are different in color content, and wherein the first pixel and fourth pixel have same color content, and the second and third pixels have same color content, and wherein the first pixel consists of a first color sub-pixel and a different second color sub-pixel arranged in parallel to each other and immediately adjacent to each other in the first direction, and the fourth pixel consists of the first color sub-pixel and the different second color sub-pixel arranged in parallel to each other and immediately adjacent to each other in the second direction, wherein each of the first color sub-pixel, the second color sub-pixel, the third color sub-pixel and the fourth color sub-pixel has a longer dimension and a shorter dimension such that the longer dimension of the first color sub-pixel is immediately adjacent to the longer dimension of the second color sub-pixel, and the longer dimension of the third color sub-pixel is immediately adjacent to the longer dimension of the fourth color sub-pixel.

7. The display panel according to claim 6, wherein the second pixel and the third pixel have a third color sub-pixel, which is different from the first color and the second color.

8. The display panel according to claim 6, wherein the second pixel consists of a third color sub-pixel and a different fourth color sub-pixel arranged in parallel to each other and immediately adjacent to each other in the first direction, and the third pixel consists of the third color sub-pixel and the fourth color sub-pixel arranged in parallel to each other and immediately adjacent to each other in the second direction.

9. The display panel according to claim 6, wherein the second pixel consists of a third color sub-pixel and a different fourth color sub-pixel arranged in parallel to each other and immediately adjacent to each other in the second direction, and the third pixel consists of the third color sub-pixel and the fourth color sub-pixel arranged in parallel to each other and immediately adjacent to each other in the first direction.

10. The display panel according to claim 7, wherein each of the first color sub-pixel and the second sub-pixel is selected from a different one of a red pixel and a green pixel, and the third color sub-pixel is a blue pixel.

11. The display panel according to claim 9, wherein each of the first color sub-pixel and the second sub-pixel is selected from a different one of a red pixel and a green pixel, and each of the third color sub-pixel and the fourth color sub-pixel is selected from a different one of a blue sub-pixel and a white sub-pixel.

12. A display apparatus comprising a plurality of pixel groups, each pixel group consisting of:

a first pixel;

a second pixel neighboring the first pixel in a first direction;

a third pixel neighboring the first pixel in a second direction; and a fourth pixel neighboring the second pixel and the third pixel, wherein the first pixel and the fourth pixel have same color content, the second pixel and the third pixel have same color content, and the first pixel and the second pixel have different color content, and wherein each of at least two of the four pixels in a pixel group consists of two different color sub-pixels, wherein the two different color sub-pixels in one of said at least two pixels are arranged in parallel to each other and immediately adjacent to each other in the first direction, wherein each of the first color sub-pixel, the second color sub-pixel, the third color sub-pixel and the fourth color sub-pixel has a longer dimension and a shorter dimension such that the longer dimension of the first color sub-pixel is immediately adjacent to the longer dimension of the second color sub-pixel, and the longer dimension of the third color sub-pixel is immediately adjacent to the longer dimension of the fourth color sub-pixel.

13. The display apparatus according to claim 12, wherein the two different color sub-pixels in another of said at least two pixels are arranged in parallel to each other and immediately adjacent to each other in the second direction.

14. The display apparatus according to claim 12, wherein the two different color sub-pixels in another of said at least two pixels are arranged in parallel to each other and immediately adjacent to each other in the first direction.

15. The display apparatus according to claim 13, wherein said at least two of four pixels are the first pixel and the fourth pixel, and each of the first pixel and the fourth pixel consists of a first color sub-pixel and a different second color sub-pixel.

16. The display apparatus according to claim 15, wherein each of the second pixel and the third pixel consists of a third color sub-pixel and a different fourth color sub-pixel.

17. The display apparatus according to claim 15, wherein each of the second pixel and the third pixel consists of a third color sub-pixel different from the first color sub-pixel and the second color sub-pixel.

18. The display apparatus according to claim 13, wherein said at least two of four pixels are the second pixel and the third pixel, and each of the second pixel and the third pixel consists of a first color sub-pixel and a different second color sub-pixel.

19. The display apparatus according to claim 18, wherein each of the first pixel and the fourth pixel consists of a third color sub-pixel and a fourth color sub-pixel.

20. The display apparatus according to claim 19, wherein each of the first color sub-pixel, the second color sub-pixel, the third color sub-pixel and the fourth color sub-pixel is selected from a different one of a red pixel, a green pixel, a blue pixel and a white pixel.

* * * * *